United States Patent [19]

LeGrand et al.

[11] Patent Number: 4,671,529

[45] Date of Patent: Jun. 9, 1987

[54] SIDE-REINFORCED SKI

[75] Inventors: Maurice LeGrand, Voiron; Henri C. DeBorde, Bilieu Charavines, both of France

[73] Assignee: Skis Rossignol S.A., Voiron, France

[21] Appl. No.: 794,232

[22] Filed: Nov. 1, 1985

[30] Foreign Application Priority Data

Nov. 5, 1984 [EP] European Pat. Off. ..... 84402216.0

[51] Int. Cl.[4] ..... A63C 5/12

[52] U.S. Cl. ..... 280/610

[58] Field of Search ..... 280/601, 609, 610, 602

[56] References Cited

U.S. PATENT DOCUMENTS

| | | | |
|---|---|---|---|
| 3,208,761 | 9/1965 | Sullivan et al. | 280/610 |
| 3,707,296 | 12/1972 | Palazzolo et al. | 280/11.13 L |
| 3,736,609 | 6/1973 | Saucier | 280/610 X |
| 3,967,992 | 7/1976 | McCaskey, Jr. et al. | 280/610 |
| 4,093,268 | 6/1978 | Sampson et al. | 280/610 |
| 4,233,098 | 11/1980 | Urbain | 280/610 X |
| 4,455,037 | 6/1984 | Pilpel et al. | 280/610 |
| 4,545,597 | 10/1985 | Meatto et al. | 280/610 |

FOREIGN PATENT DOCUMENTS

| | | | |
|---|---|---|---|
| 2003846 | 9/1985 | Fed. Rep. of Germany . | |
| 71512 | 1/1960 | France | 280/610 |
| 1424928 | 12/1965 | France | 280/610 |
| 2201106 | 9/1985 | France . | |
| 394004 | 11/1965 | Switzerland | 280/610 |
| 188873 | 1/1967 | U.S.S.R. | 280/610 |

*Primary Examiner*—John J. Love
*Assistant Examiner*—Michael Mar
*Attorney, Agent, or Firm*—Karl F. Ross; Herbert Dubno

[57] ABSTRACT

The ski comprises a central core covered by a metal blade. Bearing layers are arranged above and below the core and the blade covering it. Edges are provided laterally adjacent to a sole, with portions extending above the sole. Two side elements are arranged on either side of the core and the bearing elements and above the edges. The side elements are constituted by laminates comprising a reinforcing blade, e.g. of aluminum or aluminum alloy, whose upper end appears at the upper face of the ski and acts as an upper edge.

4 Claims, 5 Drawing Figures

SIDE-REINFORCED SKI

FIELD OF INVENTION

The present invention relates to a ski comprising, in cross section, a central core, bearing elements arranged above and below this core, a lower sliding sole or running surface, an upper decorative layer, two edges which are laterally adjacent to the sole and of which a portion extends above a marginal portion of its upper face, and two side elements arranged laterally on either side of the core.

BACKGROUND OF THE INVENTION

The structure of skis generally comprises a solid or hollow core and bearing elements arranged above and below this core which can be produced in one or two layers, for example from a glass fiber fabric impregnated with epoxy resin which may possibly be combined with a metallic blade made of aluminum or aluminum alloy of the Zicral 7075 type.

Skis provided with lateral reinforcements are also in existence. Thus, U.S. Pat. No. 4,093,268 relates to a ski in which a glass fiber reinforcement is arranged between a side element and the core and extends vertically between a lower edge and an upper edge. A similar structure is illustrated in U.S. Pat. No. 3,967,992.

More recently, U.S. Pat. No. 4,455,037 has described a structure in which a metallic reinforcing blade is interposed between the side elements forming the lateral faces of the ski and a wooden core, these reinforcing blades extending between a lower bearing layer and upper edges.

The production of skis having a tubular metallic framework has also been proposed, as described in the second addition FR-A No. 84,816 to FR-A No. 1,276,744, as well as in U.S. Pat. No. 3,208,761, in which the upper corners of the ski are constituted by the metal of the tubular structure. This design is quite different from that of skis formed from distinct elements assembled round a central core, since the tubular structure gives the ski all its mechanical properties. Such solutions pose extremely complex technological problems because the tubular structure is produced by menas of shaped sections. Now the cross-section of a ski varies constantly. This is why almost all skis are produced by means of layers arranged round a central core, either by dry means, that is to say by means of pre-fabricated layers assembled by sticking, or by moist means, or by polymerizing impregnating resins at the same time as the various constituents of the ski are stuck, or by injecting certain structural elements, in particular the core, after having pre-assembled the elements of the structure surrounding it in a mold.

The upper surface of the ski which also constitutes the decorative portion thereof is particularly exposed to harmful external factors which may damage it by causing obvious wear of the ski which devalues it even if its mechanical properties do not suffer. This is why a large number of skis have not only lower edges intended to improve the grip of the ski on the snow or the ice but also upper edges intended to protect the decorative portion, in particular during cross-over of the skis. With regard to manufacture of the ski, these upper edges increase the number of parts to be assembled and they complicate the structure of the ski because, like the lower edges, they have to be fixed in the ski.

OBJECT OF THE INVENTION

The object of the present invention is to provide a solution which is more economical than hitherto for protecting the upper face of the ski while employing a traditional method of manufacture by assembly of elements in strips round a core, either by dry means or by moist means.

SUMMARY OF THE INVENTION

To this end, the present invention provides a ski comprising, in cross-section, a central core, bearing elements arranged above and below this core, a lower sliding sole, an upper decorative layer, two edges which are laterally adjacent to the sole and of which a portion extends above a marginal portion of its upper face and two side elements forming the lateral faces of the ski, the side elements being produced from a laminate having at least one reinforcing layer arranged between layers of which one of each element forms one of the lateral faces of the ski, the end of the reinforcing layer appearing at the upper face of the ski and extending laterally to said upper decorative layer.

The structure of the ski according to the invention has several advantages. In particular, it enables the problem of protecting the upper face of the ski to be solved simply and effectively. This structure also provides effective protection against sinking of the lower edges and advantageously allows the bearing element to be constituted by a single layer whose thickness is completely independent of the fixing portion of the lower edges by causing the thickness of the side elements and the width of the edge fixing portions to correspond. The number of elements is thus reduced and the assembly thereof for adhesion is simplified.

BRIEF DESCRIPTION OF THE DRAWING

Further objects and advantages will appear in the following description, illustrated by the accompanying drawing which shows, by way of example, various embodiments of the ski forming the subject of the present invention.

SPECIFIC DESCRIPTION

Figure 1:
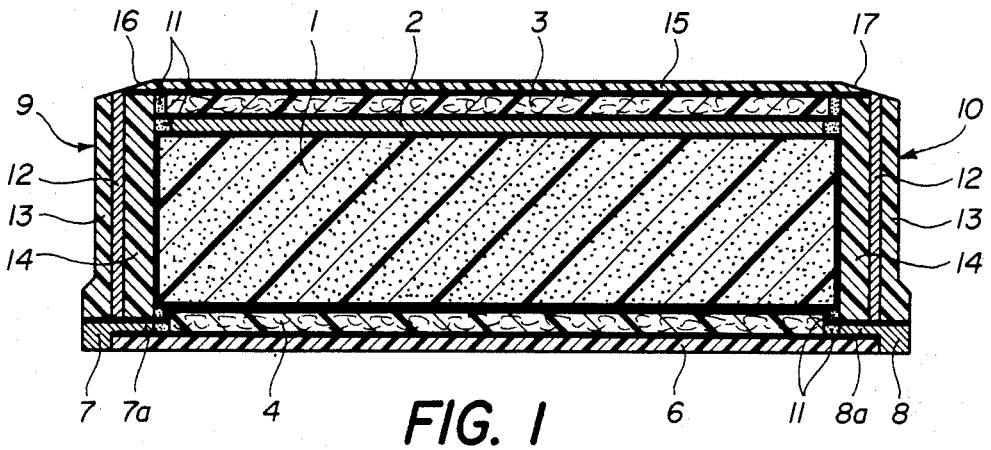
FIG. 1 is a cross-sectional view of a first embodiment.

The embodiment illustrated in FIG. 1 comprises a core 1 which can be produced from a rigid foam of a polymer such as polyurethane, for example. Bearing layers 3 and 4 are arranged respectively above and below the core 1. These two bearing layers 3, 4 are constituted by materials having a high modulus of elasticity, for example by a laminate of glass fibers, carbon fibers, or Kevlar fibers, by a type 7075 alumimum alloy, etc., or by a combination of such materials. A reinforcing plate 2 intended to hold the fixing screws securely can be arranged in the fixing means assembly zone. A sliding sole 6 extends beneath the lower bearing layer 4. This sole 6 is laterally bordered by edges 7 and 8 having portions 7*a* and 8*a* repectively extending above the sole 6 into the vicinity of the respective borders of the bearing layer 4. Each edge 7 and 8 is adjacent to a respective side element 9 and 10 whose thickness corresponds to the width of the portions 7*a*, 8*a* of the edges 7 and 8 extending above the sole 6. The spaces 11 defined between the border of the bearing layers 3 and 4, the borders of the metal plate 2, and the internal faces of the side elments 9 and 10 are intended to receive the surplus adhesive which serves to stick together the various components of the ski.

Each side element 9 and 10 is constituted by a laminate comprising three layers, i.e. an intermediate reinforcing blade 12 and two layers of polymer or of phenolic laminate 13 and 14 arranged on either side of the reinforcing blade 12. In one embodiment, the reinforcing blade 12 is composed of aluminum or of Zicral 7075 type aluminum alloy and the layers of polymer are stuck on the faces of this blade. The symmetry of the part prevents deformation during hot adhesion. Other reinforcing layers can be considered, such as a laminate similar to the one used for forming bearing layers 3 and 4, composed of glass fiber fabric immersed in epoxy resin, for example.

The other face of the ski formed by the external face of the upper bearing layer 3 and the upper ends of the side elements 9 and 10 is covered by a protective layer 15 constituting the decorative face of the ski. Two marginal portions of this layer 15 are then eliminated by bevels 16 and 17 revealing the upper ends or edges of the reinforcing blades 12, which thus act as protective upper edges for the ski body.

By extending the edges 7 and 8 to the upper face of the ski, the reinforcing blades 12 perform several roles: they prevent sinking of these edges 7 and 8 during impacts and they provide protection for the upper borders of the ski while providing the ski with reinforcement with respect to lateral flexion and torsion. The laminated side elements 9 and 10 in which the reinforcing blades 12 are sandwiched preferably have a thickness equal to the width of the portions *7a* and *8a* of the edges 7 and 8. As protection against sinking is provided by the reinforcing blades 12, the bearing layer 4 does not need to extend above the edges. Consequently, it is no longer necessary to have two bearing layers of differing widths, one arranged between the internal borders of the portions *7a,8a,* of the edges 7 and 8 and the other covering these portions *7a,8a* to prevent the edges from sinking. These two conventional bearing layers are thus replaced by a single bearing layer 4. Not only does this simplify assembly and adhesion of the layers forming the ski, but the upper and lower bearing elements 3 and 4 can be of the same thickness and same width, allowing a saving in production costs.

The ski structure described above is particularly suitable for manufacture by dry means, that is by adhesion of layers of polymerized materials which have been pre-cut to the desired dimensions and combined with one another. This structure is obviously not limited to this method of manufacture but assists it by the simplifications which it contributes.

Figure 2A:
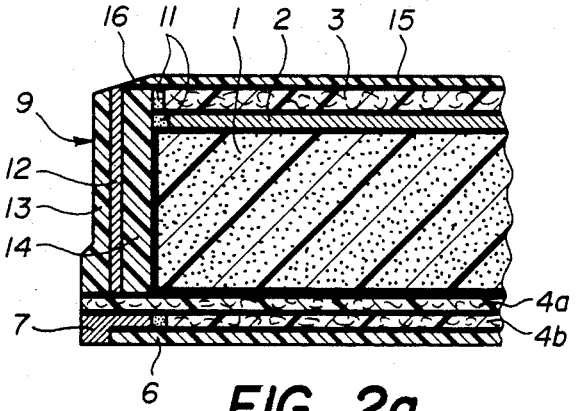
FIGS. 2*a* and 2*b* are fragmentary cross-sectional views of two modified embodiments.

However, there is nothing to stop a return to a conventional structure with two bearing layers 4*a* and 4*b*, as illustrated by the embodiment in FIG. 2*a*. In this case, the thickness of the laminate forming the side elements 9 and 10 may be different from the width of the portions *7a* and *7b* of the edges 7 and 8. Otherwise, this embodiment is identical to the previous embodiment and the same elements are designated by the same reference numerals. For these reasons, this embodiment will not be described further.

Figure 2B:
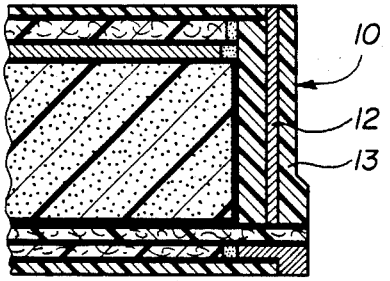

The embodiment in FIG. 2*b*, which is obviously also applicable to FIG. 1, shows a ski without the chamfer 16. The decorative layer 15 stops against the reinforcing blade 12. The reinforcing blade 12 comes to the level of the decorative layer 15, as does the polymer layer 13.

Figure 3A:
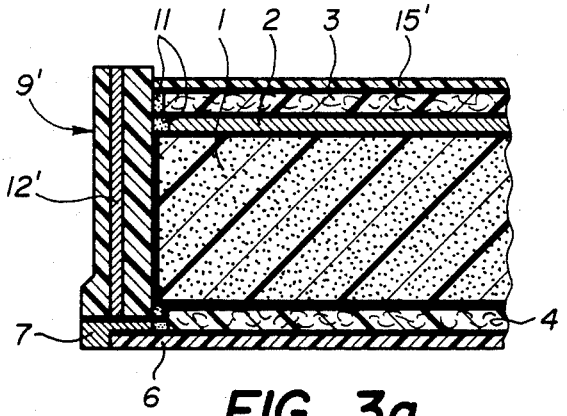
FIGS. 3*a* and 3*b* are framentary cross-sectional views of a further two modified embodiments.

The embodiment illustrated in FIG. 3*a*, which is obviously applicable to the skis illustrated in FIGS. 1,2*a*, and 2*b* differs from these in that the upper end of the side element 9' extends to a level higher than that of the protective layer 15' constituting the decorative face of the ski, which is thus narrower. This embodiment aims to provide better protection for the upper face of the ski by the reinforcing blade 12'. The other elements of this embodiment are identical to those described with regard to FIG. 1 and will not therefore be described again here.

Figure 3B:
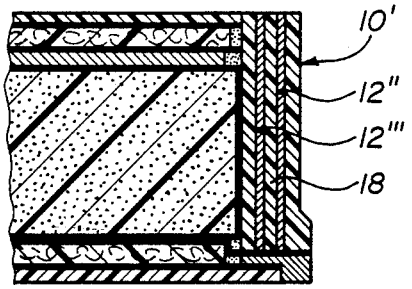

The embodiment in FIG. 3*b* shows a side element 10' which arrives flush with the decorative surface 15'. Furthermore, this side element comprises two parallel reinforcing blades 12'' and 12''' separated by an intermediate polymer layer 18.

Although the embodiments described above show skis having a solid core 1, it is obvious to a person skilled in the art that it is possible to substitute for it a core which is internally hollowed.

We claim:

1. A ski, comprising:

a solid foam core of rectangular cross section and composed of a foamed synthetic resin material occupying a major portion of the cross section of the ski;

an upper bearing element of comparatively high modulus of elasticity overlying said foam core and having a width at most equal to the width of said core;

an upper decorative layer overlying said upper bearing element and defining an upper surface of said ski over a width at least equal to the width of said core;

a lower bearing element of comparatively high modulus of elasticity underlying said core;

a sliding sole forming a running surface for said ski underlying said lower bearing element and having a width greater than the width of said core;

a pair of edge strips each extending along one longitudinal edge of said sliding sole and having a lower portion flush with said running surface and an upper portion extending inwardly over said sliding sole; and respective side elements flanking each longitudinal side of said core, each of said side elements being formed as a laminate of an inner synthetic resin layer in direct contact with a respective longitudinal side of said core, a metal blade overlying each said inner synthetic resin layer, and an outer synthetic resin layer overlying each said metal blade and defining a lateral surface of the ski, the thickness of each of said side elements at the bottom thereof being substantially equal to the width of a respective said upper portion of an edge strip upon which the side element rests, at least an upper edge of the outer layer and said blade of each of said side elements being exposed at the upper surface of the ski adjacent said upper decorative layer, said foam core, said screw-anchor plate, said bearing elements, said sliding sole, said side elements and said edge strips being interconnected to form an integral ski body.

2. The ski defined in claim 1 wherein said bearing layer has a thickness greater than the thickness of said upper portion of said edge strips overlying said sliding sole along each of said longitudinal edges thereof.

3. The ski defined in claim 1 wherein each of said side elements has an upper margin lying at a level above the upper surface of said decorative layer.

4. The ski defined in claim 1 wherein each of said side elements has an upper margin which is coplanar with the upper surface of said decorative layer.

* * * * *